US008066449B2

(12) United States Patent
Lux, III

(10) Patent No.: US 8,066,449 B2
(45) Date of Patent: Nov. 29, 2011

(54) METHOD FOR DRY ISOLATION OF A WATER PASSAGE OF A DAM

(75) Inventor: Frederick Lux, III, Eau Claire, WI (US)

(73) Assignee: Aubian Engineering, Inc., Madison, WI (US)

( * ) Notice: Subject to any disclaimer, the term of this patent is extended or adjusted under 35 U.S.C. 154(b) by 1089 days.

(21) Appl. No.: 11/744,972

(22) Filed: May 7, 2007

(65) Prior Publication Data

US 2008/0008529 A1 Jan. 10, 2008

Related U.S. Application Data

(63) Continuation-in-part of application No. 10/198,780, filed on Jul. 18, 2002, now Pat. No. 7,214,003.

(51) Int. Cl.

| | |
|---|---|
| ***E02B 7/24*** | (2006.01) |
| ***E02B 7/14*** | (2006.01) |
| *E02B 7/26* | (2006.01) |

(52) U.S. Cl. ..... 405/13; 405/111; 405/114

(58) Field of Classification Search ..... 405/87, 405/98, 103, 104, 11, 13, 80, 107, 108, 110, 405/111, 112, 114

See application file for complete search history.

(56) References Cited

U.S. PATENT DOCUMENTS

| | | | | |
|---|---|---|---|---|
| 4,484,836 | A * | 11/1984 | Bailard | 405/64 |
| 4,582,296 | A * | 4/1986 | Bachmann | 251/326 |
| 5,634,742 | A * | 6/1997 | Mills | 405/87 |

* cited by examiner

*Primary Examiner* — Michael Safavi

(74) *Attorney, Agent, or Firm* — Anthony J. Bourget

(57) ABSTRACT

A needle-beam cofferdam, needles and associated method for dry isolation of a water passage of a dam, the method comprising providing a support beam which spans between piers of the water passage, providing at least one hollow metal needle having a major axis, and positioning the hollow needle with the major axis substantially vertically oriented, the hollow needle engaging with a sill of the dam and engaging with the support beam. A plurality of vertically positioned needles may thereby isolate the water passage. The method also includes positioning of hollow needles with the major axis in a substantially horizontal orientation.

18 Claims, 11 Drawing Sheets

METHOD FOR DRY ISOLATION OF A WATER PASSAGE OF A DAM

The present application is a continuation-in-part of, and claims priority to, U.S. patent application Ser. No. 10/198,780, filed Jul. 18, 2002, now U.S. Pat. No. 7,214,003 issued May 8, 2007, which is hereby incorporated by reference as if fully reproduced herein.

BACKGROUND OF THE INVENTION

1. Field of the Invention

The present invention relates generally to a bulkhead assembly for dewatering water passages of dams and, more particularly, to a floating bulkhead assembly and, most particularly, to a segmental floating bulkhead assembly, and floatable caisson for this purpose.

2. Background Information

The standard means for dewatering dam intakes and outlets, such as spillways, outlet works, penstocks and draft tubes, has been with bulkhead assemblies or stop logs placed in opposing slots set in the passageway walls. A bulkhead assembly is a one-piece fabrication that is positioned across the water passage opening in slots to allow the water passage to be dewatered without having to lower the reservoir. The bulkhead assembly is usually lowered into place from the top of the dam with a mobile crane, gantry crane or permanent hoist. For large openings, where a one-piece bulkhead assembly is impractical, a series of horizontal bulkhead assemblies, called stop logs, are placed in the slots and stacked one on top of the next, using the same type of lifting devices used for the one-piece bulkhead assemblies. Bulkhead assemblies and stop logs are made from timber, aluminum or stainless steel for small passages, but larger openings mandate steel fabrications. When not in use, the bulkhead assemblies or stop logs are suspended above the water passage or placed in a dry storage location.

The use of buoyancy for bulkhead assemblies to reduce or eliminate the need for hoists or cranes is known. Older floating bulkhead assemblies often were one-piece steel fabrications used at site-specific intakes and stored permanently in the reservoir or removed with a large capacity crane after use. These bulkhead assemblies are designed similar to a ship. The floating bulkhead assembly's bottom is filled with ballast to keep it upright, and the bulkhead assembly is partitioned into chambers that are flooded or purged to adjust the trim of the bulkhead assembly.

Many of these floating bulkhead assemblies are still in use. However, they are difficult to maneuver and operate, more costly to fabricate than conventional bulkhead assemblies, and expensive to maintain. If not maintained, floating bulkhead assemblies may be deemed unsafe to operate due to unknown conditions in the sealed chambers, internal steel corrosion or unreliable components.

Some examples of inventions concerned with bulkhead assemblies for which patents have been granted are found in the following: Mills, U.S. Pat. No. 5,634,742, and Tucker, U.S. Pat. No. 4,729,692. Additionally, various other designs have been used or considered as shown in the literature, including the Northern States Power Company and Ayres Associates hinged bulkhead assembly described in Trends, a Publication of Ayres Associates, "Dam Renovation—Hinged Floating Bulkhead Assembly Proves Flexible, Reusable", Autumn, 1987 ("Ayres Design"), and further described by Bakken and Vonasek in Proceedings: Small Hydro 1988, Ministry of Energy, Toronto, Canada, "Floating Bulkhead Assembly Installed for Hydro Intake Repair," July 1988, among others. However, these disclosed devices embody many of the shortcomings outlined above, resulting in a need for an economical, easily fabricated bulkhead assembly, which is readily handled without large, expensive equipment.

The Ayres Design, which utilizes wide flange steel beams, has several drawbacks compared to the use of hollow rectangular section steel tubes made from flat sheet. Fabrication using wide flange beams to create a workable caisson requires a great amount of skillful cutting and welding of the beams, which increases the cost of fabrication. Wide flange beams are not produced in many useable varieties or dimensions, and heavy customization is often required. This lack of variety also lessens the engineering options. With wide flange beams, the bottom chamber is generally required to be the sealable chamber of the caisson, which in turn, dictates or limits the engineering options for the size of the caisson. Bakken and Vonasek reference the drawbacks with the use of rolled rectangular tube sections as being quite heavy and, due to the limited depths available in rolled steel tubes, the anticipated deflections of the units at the bottom of the wall would be excessive and could potentially cause problems with the bottom seal. Also, a drawback of using large dimension tube sections, for instance, tube sections greater than approximately 0.7 meters wide, is the excess weight and cost. The device of the present invention meets these needs, while providing many additional features that are unique to the methods and structures described herein.

FIG. 13A and FIG. 13B is a depiction of a prior art needle-beam cofferdam 400. Details of cofferdam 400 were presented in part by applicant at Waterpower '95, San Francisco, Calif., July 1995, reprinted from WATERPOWER '95 Proceedings of the International Conference on Hydropower, Published by ASCE under the title "Closure Methods for Large Intakes" by Frederick Lux II, P. E., Richard M. Rudolph, P. E., and Richard K. Frithiof, P. E., which is hereby incorporated herein by reference.

Cofferdam 400 consist of one or more horizontal structural members that act as support beams for vertical wood or steel members (needles). Generally, such closure method is used for intakes with shallow depths and long spans. For reservoir heads less than about 2.5 meters high, wood needles can be used with a single support beam at the top and a seat at the crest. However, interlocking steel sheet-pile needles are usually the most economical and provide adequate sealing for most intakes.

Alternative needle-beam or similar types of arrangement applicable for other projects involves use of needle beams or of panelized systems. One such panelized system includes that presented in part by applicant at Waterpower '05, Austin Tex., July 2005, and under the publication "Reverse Needle-Beam Cofferdam for Spillway Bay Dewatering at Tom Miller Dam" by M. Leslie Boyd, P. E., Freese & Nichols, Inc.; Frederick Lux III, P. E., Aubian Engineering, Inc.; Gregor A. Forbes and Thomas M. Glynn, Lower Colorado River Authority, which is hereby incorporated herein by reference.

The needles of such prior systems are unworkable for some applications due to the structural forces and therefore such systems are limited to relatively short length and have limited use. Such needles also are not floatable, and are not floodable in order to selectively orient needles from a generally horizontal attitude on the water to a generally vertical attitude. Applicant's present invention has overcome these and other limitations of prior designs.

SUMMARY OF THE INVENTION

The present invention is directed to the structure of a floatable caisson member and to a segmental floatable bulkhead assembly formed by assembling a plurality of the floatable caisson members. Dewatering a water passage of a dam is achieved by employing a segmental floatable bulkhead assembly formed by assembling a plurality of the floatable caisson members.

In one embodiment of the invention, the floatable caisson member includes at least two hollow, rectangular section, HSS steel tubes made from flat sheet steel, each tube sealed at each end by a tube end plate to form at least two sealed chambers. A side plate is secured to the at least two steel tubes, with the at least two steel tubes and the side plate defining at least one intermediate space. At least one pair of intermediate space end plates is secured between adjacent tubes of the at least two tubes. At least one intermediate chamber plate is secured to the at least two steel tubes opposite the side plate. The intermediate chamber plate seals at least a portion of the at least one intermediate space to create at least another sealed chamber. At least one sealed chamber includes at least one sealable aperture to selectively flood the sealed chamber and to evacuate water from the sealed chamber. The sealed chambers may be selectively flooded and evacuated to effectuate the desired submersion, installation and removal of the floatable caisson member from the water passage of a dam.

One method of fabrication of the floatable caisson member includes the steps of providing at least two hollow, rectangular section, HSS steel tubes and connecting the tubes in parallel with a side plate, with the tubes and side plate defining at least one intermediate space. The at least two tubes are sealed with tube end plates to form at least two sealed chambers. At least a portion of the at least one intermediate space is sealed to create at least another sealed chamber. At least one sealed chamber includes at least one sealable aperture to selectively flood the sealed chamber and to evacuate water from the sealed chamber. The chambers may be selectively flooded and evacuated to effectuate desired submersion, installation and removal of the caisson member from the water passage of a dam.

Another embodiment of the present invention includes a bulkhead assembly for dry isolation of a water passage of a dam. The bulkhead assembly comprises a plurality of floatable caisson members bound together to form a platform assembly adapted to float in a horizontal attitude on a water body surface. At least one of the caisson members includes at least two HSS steel tubes connected in parallel with a side plate, the HSS tubes and the side plate defining at least one intermediate space. The at least two tubes are sealed with tube end plates to form at least two sealed chambers, and at least a portion of the at least one intermediate space is sealed to create at least another sealed chamber, with at least one of the sealed chambers including at least one sealable aperture to selectively flood the sealed chamber and to evacuate water from the sealed chamber to cause the bulkhead selectively to move between the horizontal attitude and a vertical attitude in the water body, and selectively to reduce and increase buoyancy of the bulkhead assembly. At least one of the floatable caisson members includes a sealable conduit for selectively permitting flow of water from the water body through the bulkhead assembly.

The invention also comprises one method for isolating a water passage of a dam from a body of water, including the steps of providing a plurality of floatable caisson members adapted for binding together to form a single, panel bulkhead assembly that floats in a horizontal attitude on a water body surface. At least one of the caisson members includes at least two HSS steel tubes connected in parallel with a side plate, the HSS tubes and the side plate defining at least one intermediate space. The at least two tubes are sealed with tube end plates to form at least two sealed chambers, and at least a portion of the at least one intermediate space is sealed to create at least another sealed chamber, with at least one of the sealed chambers including at least one sealable aperture to selectively flood the sealed chamber and evacuate water from the sealed chamber. The floatable caisson members are connected together to form a rigid, single panel bulkhead assembly adapted to float in horizontal attitude on the surface of the body of water. At least one of the sealed chambers is flooded to cause the bulkhead assembly to move from the horizontal attitude to a vertical attitude in the body of water. The bulkhead assembly is moved in the vertical attitude to a position contacting water passage piers. The bulkhead assembly is held against the piers, and at least a further of the at least one sealed chambers is flooded to reduce buoyancy of the bulkhead assembly to cause the bulkhead assembly to sink to the sill of the water passage. Water from an area behind the bulkhead assembly is then evacuated.

The invention also comprises another method for isolating a water passage of a dam from a body of water, including the steps of providing a plurality of floatable caisson members adapted for rotatably binding together to form a segmental bulkhead assembly that floats in a horizontal attitude on a water body surface. At least one of the caisson members includes at least two HSS steel tubes connected in parallel with a side plate, the HSS tubes and the side plate defining at least one intermediate space, the at least two tubes sealed with tube end plates to form at least two sealed chambers, with at least a portion of the at least one intermediate space sealed to create at least another sealed chamber, and with at least one of the sealed chambers including at least one sealable aperture to selectively flood the sealed chamber and evacuate water from the sealed chamber.

At least two of the floatable caisson members are rotatably connected together to form a rotatable, segmental bulkhead assembly adapted to float in the horizontal attitude on the surface of the body of water. The bulkhead assembly is moved in the horizontal attitude to a position adjacent water passage piers, with one caisson member floating adjacent the water passage and one caisson member floating opposite the water passage. At least one sealed chamber of the bulkhead assembly caisson member adjacent the water passage is flooded to cause the caisson member to move from the horizontal attitude to a submerged vertical attitude in the body of water. The flooding step is repeated for selected sealed chambers of selected floating caisson members to move that caisson member to a submerged vertical attitude, causing the segmental bulkhead assembly to sink to the sill of the water passage. Water from an area behind the segmental bulkhead assembly is then evacuated.

A further aspect of the present invention includes a method for dry isolation of a water passage of a dam, the method comprising providing a support beam which spans between piers of the water passage, providing at least one hollow metal needle having a major axis, and positioning the hollow needle with the major axis substantially vertically oriented, the hollow needle engaging with a sill of the dam and engaging with the support beam.

A further aspect of the present invention includes a method for dry isolation of a water passage of a dam, the method comprising providing at least one floatable needle comprising at least two HSS steel tubes, at least one of the HSS steel tubes having a rectangular cross section and defining a major axis, a side plate welded to the at least two HSS steel tubes, the at least two steel HSS tubes and the side plate defining at least one intermediate space between the at least two HSS steel tubes. And at least one of the intermediate space and the at least two HSS steel tubes sealed to form a sealed chamber, and positioning the needle adjacent the water passage of the dam such that the major axis is substantially vertically oriented.

A further aspect of the present invention includes a method for dry isolation of a water passage of a dam, the method comprising providing at least a first floatable needle and at least a second floatable needle, the at least first needle comprising at least two HSS steel tubes, at least one of the HSS steel tubes having a rectangular cross section and defining a major axis, a side plate welded to the at least two HSS steel tubes, the at least two steel HSS tubes and the side plate defining at least one intermediate space between the at least two HSS steel tubes, and at least one of the intermediate space and the at least two HSS steel tubes sealed to form a sealed chamber, positioning the first needle adjacent the water passage of the dam, and positioning the second needle adjacent the first needle.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
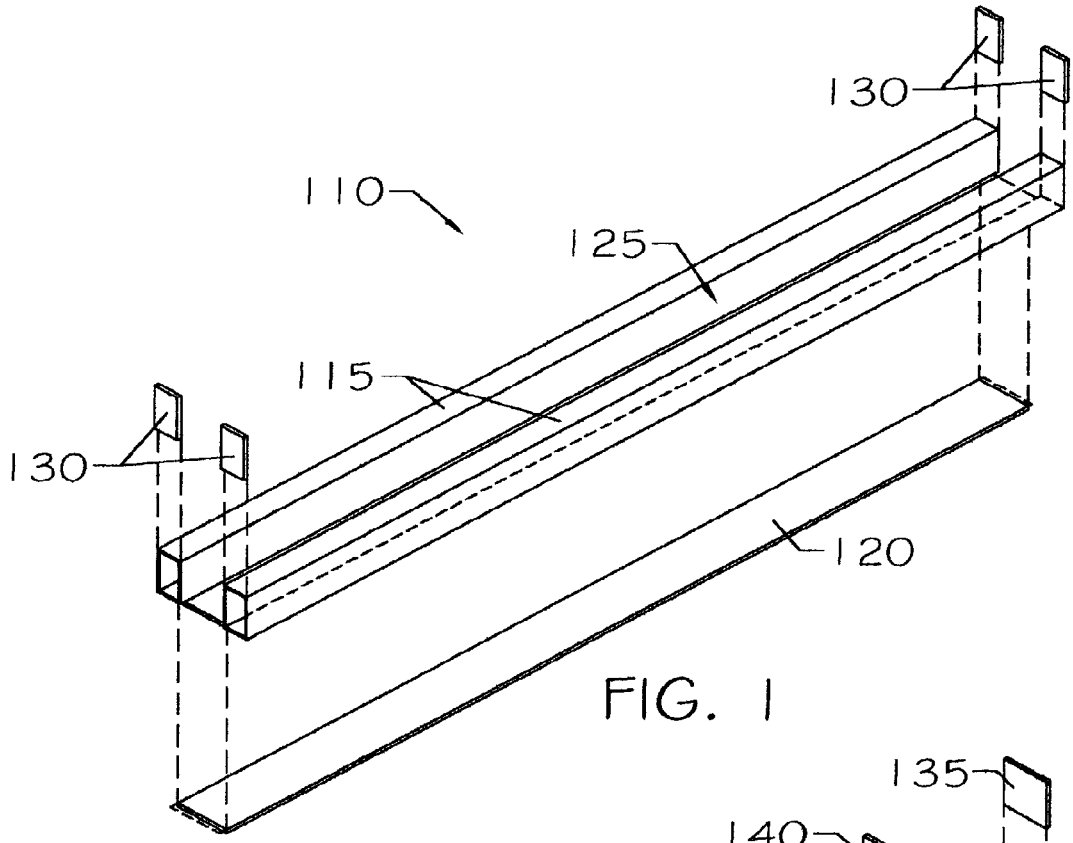
FIG. 1 shows a perspective view of one step in the fabrication of one embodiment of the floatable caisson member of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

DETAILED DESCRIPTION OF THE INVENTION

The present invention is directed to a floatable caisson member for use with a bulkhead assembly for dry isolation of water passages of a dam. In one embodiment of the invention, the floatable caisson member includes at least two hollow, rectangular section, HSS steel tubes made from flat sheet steel, each tube sealed at each end by a tube end plate to form at least two sealed chambers. A side plate is secured to the at least two steel tubes, with the at least two steel tubes and the side plate defining at least one intermediate space. At least one pair of intermediate space end plates is secured between adjacent tubes of the at least two tubes. At least one intermediate chamber plate is secured to the at least two steel tubes opposite the side plate. The intermediate chamber plate seals at least a portion of the at least one intermediate space to create at least another sealed chamber. At least one sealed chamber includes at least one sealable aperture to selectively flood the sealed chamber and evacuate water from the sealed chamber. At least one of the sealed chambers is selectively flooded and evacuated to effectuate the desired submersion, installation and removal of the floatable caisson member from a water passage of a dam.

One method of fabrication of the floatable caisson member includes the steps of providing at least two hollow, rectangular section, HSS steel tubes and connecting the tubes in parallel with a side plate, with the tubes and side plate defining at least one intermediate space. The at least two tubes are sealed with tube end plates to form at least two sealed chambers. At least a portion of the at least one intermediate space is sealed to create at least another sealed chamber. At least one sealed chamber includes at least one sealable aperture to selectively flood the sealed chamber and evacuate water from the sealed chamber. At least one of the sealed chambers is selectively flooded and evacuated to effectuate desired submersion, installation and removal of the caisson member from water passage of a dam.

There are five general criteria for individual caisson members that assemble to form a segmental bulkhead assembly for water passage control during dam or gate repairs.

1. Each caisson member floats or sinks dependent upon the amount of water it contains.

2. The caisson member structure must resist the maximum hydraulic pressures encountered in all contemplated applications.

3. The caisson member structure must be water tight with no unintended air or water leakage.

4. The caisson member structure must provide for controlled addition and removal of water ballast to prevent sudden or uncontrolled movement of the caisson member structure during installation and removal.

5. The caisson member structure must be of suitable size and strength for portability between points of use.

Referring to FIGS. 1-12, several embodiments of the floatable caisson member device of the present invention are shown. The structural features of the floatable caisson member of the present invention are best understood by describing the fabrication of such a floatable caisson member. The method of fabrication of the floatable caisson member is also unique and comprises one facet of the present invention.

Figure 2:
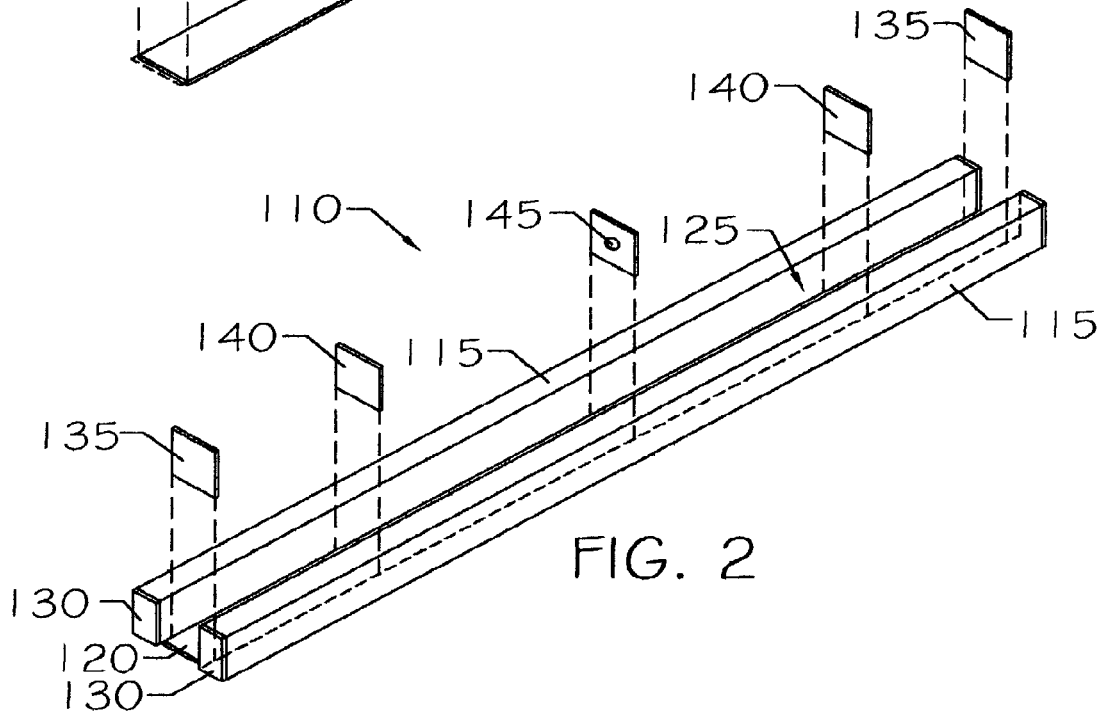
FIG. 2 shows a perspective view of another step in the fabrication of one embodiment of the floatable caisson member of the present invention.
Figure 3:
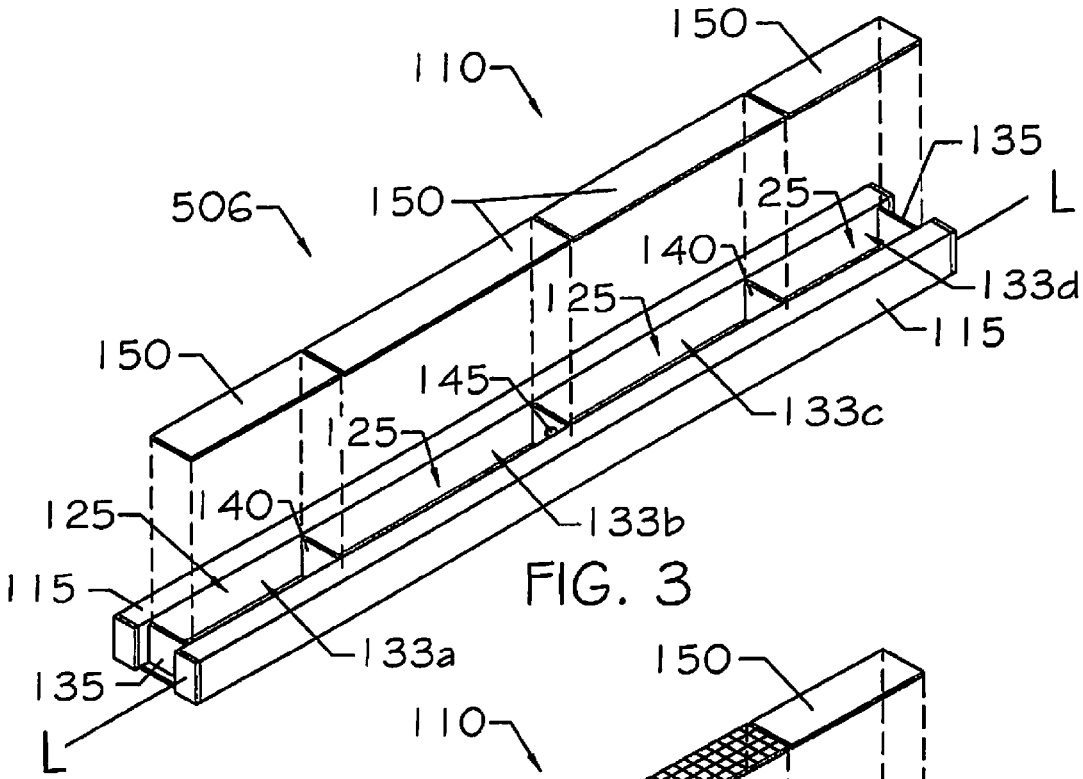
FIG. 3 shows a perspective view of another step in the fabrication of one embodiment of the floatable caisson member of the present invention.

Referring now to FIGS. 1-3, the fabrication of one embodiment of the floatable caisson member 110 includes the steps of providing at least two hollow, rectangular section, steel tubes 115. These tubes are known as Hollow Structural Section (HSS) tubes that are fabricated by bending flat sheet steel, preferably by utilizing a Form-Square Weld-Square Process, or a Submerged Arc Weld Process, which is also known as the Brake Form Process. This embodiment is illustrated with two HSS steel tubes 115, but three or more HSS steel tubes 115 can be included with equivalent results. The HSS steel tubes 115 are preferably fabricated with a step of bending flat steel sheet that has a thickness sufficient to provide the structural characteristics required for use in a floatable caisson member 110. The HSS steel tubes 115 have a length sufficient to span a water opening of a dam either vertically or horizontally, so that a bulkhead assembly made from a plurality of floatable caisson members 110 can isolate the water opening from a body of water. The HSS steel tubes 115 are preferably of equal length and of similar rectangular section.

A side plate 120 is fastened or joined, preferably by welding, to the at least two HSS steel tubes 115, with the at least two HSS steel tubes 115 and the side plate 120 defining at least one intermediate space 125, which has a rectangular cross section. In this embodiment, the side plate 120 extends between adjacent edges of the parallel HSS steel tubes 115. The side plate 120 is secured, preferably by welding, to the adjacent edges of each HSS steel tube 115, as shown in FIGS. 1 and 2. The HSS steel tubes 115 are sealed with end plates 130 so that the sealed HSS tubes 115 become chambers to selectively hold and release air. At least one pair of intermediate space end plates 135 is secured between adjacent HSS tubes 115. The intermediate space end plates 135 may be positioned anywhere within the intermediate space or at the end positions of the intermediate space, however, are preferably installed short of the ends of each HSS tube 115, as illustrated in FIGS. 2 and 3, such that the end plates 135 also function as diaphragms between the HSS tubes 115 and impart improved structural integrity to the floatable caisson member 110. Installing end plates 135 in such a recessed manner also eases the structural fastening of end plates 135 and fabrication of caisson member 110. Installing at least one intermediate chamber plate 150 to the tubes 115 opposite the side plate 120 seals the intermediate space to provide at least one additional sealed chamber. The intermediate chamber plate 150 may extend the length of the tubes 115, but preferably more than one plate 150 is utilized. Tubes 115 become sealed when joined with tube end plates 130 to become sealed chambers, and space 125 (or a portion thereof), is also sealed such that space 125 becomes a sealed chamber. Thus, reference made herein to a sealed chamber is reference made to a sealed tube 115 or a sealed space 125 (or portion thereof), or both.

In a further embodiment of the invention, at least one diaphragm 140 is installed within the intermediate space 125 to subdivide the space 125, as illustrated in FIG. 2, where three such diaphragms 140 are installed. Installing at least one intermediate chamber plate 150 to the tubes 115 opposite the side plate 120 seals the intermediate space 125 to provide at least one additional sealed chamber. Preferably, the intermediate chamber plate 150 is secured, preferably by welding, to the adjacent tube edges of the intermediate space 125 opposite the side plate 120. As illustrated in FIG. 3, where the intermediate spaces 125 includes three diaphragms 140, the resulting four intermediate chambers 125 are sealed with four intermediate chamber plates 150. Each of the four intermediate spaces 125 may therefore be configured as sealable, intermediate chambers or sealed intermediate sub-chamber portions. One or more diaphragms 140 may include an opening 145 that provides fluid communication between adjacent sealed intermediate chambers. The opening 145 may be a central aperture or selectively designed with slots or openings. The chamber plates 150 are secured, preferably by welding to the end plate 135 and the diaphragm 140, as well as to the adjacent tube edges, to seal the intermediate space 125.

Figure 4:
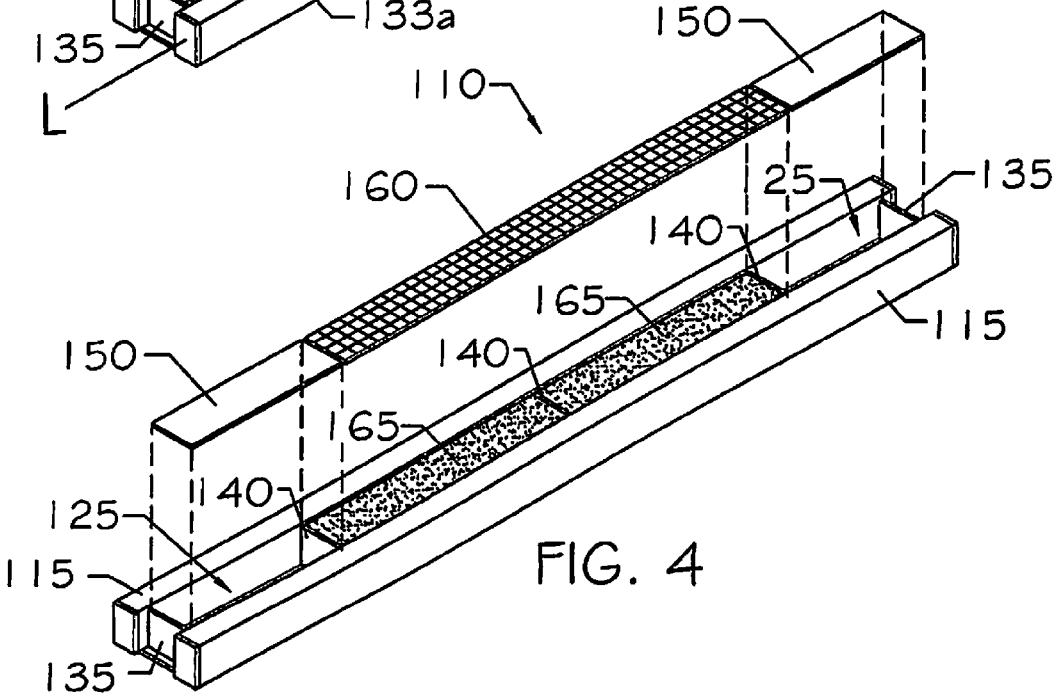
FIG. 4 shows a perspective view of an alternative step in the fabrication of one embodiment of the floatable caisson member of the present invention.

An alternative embodiment of the invention disclosed in FIGS. 1-3 is shown in FIG. 4. Referring to FIG. 4, the caisson member's intermediate space 125 is divided into four subchambers by three diaphragms 140, as described above. The two end subchambers are sealed by securing, preferably by welding an intermediate chamber plate 150 to the tube edges, the intermediate space end plate 135, and one diaphragm 140. The interior intermediate subchambers are covered only by intermediate chamber cover screens 160, leaving a void that fills with water upon submersion of the floatable caisson member. In a further embodiment, shown in FIG. 4, the interior, intermediate subchamber voids beneath the cover screens 160 are filled with buoyant foam material 165 to exclude water from the voids, thereby adjusting the buoyancy of the floatable caisson member 110.

Further aspects of the previous embodiments are described later with respect to a completed caisson such as that shown in FIG. 9A.

Figure 5:
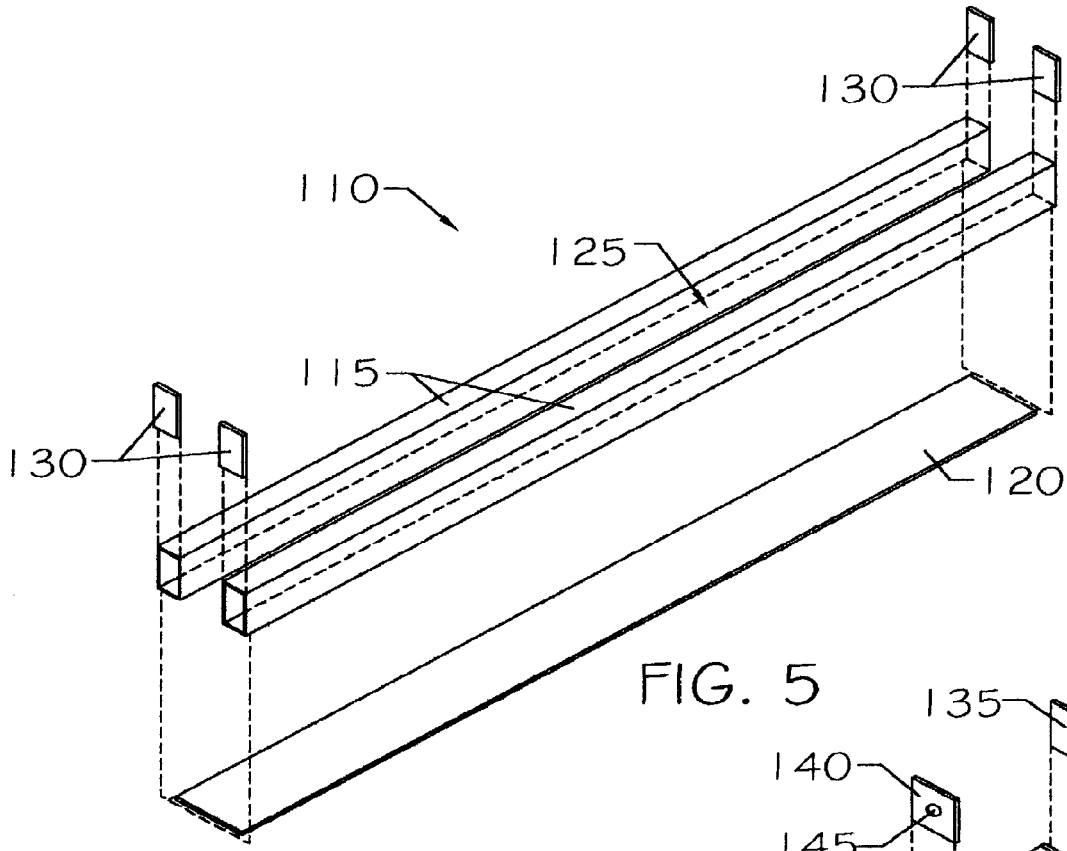
FIG. 5 shows a perspective view of one step in the fabrication of another embodiment of the floatable caisson member of the present invention.
Figure 6:
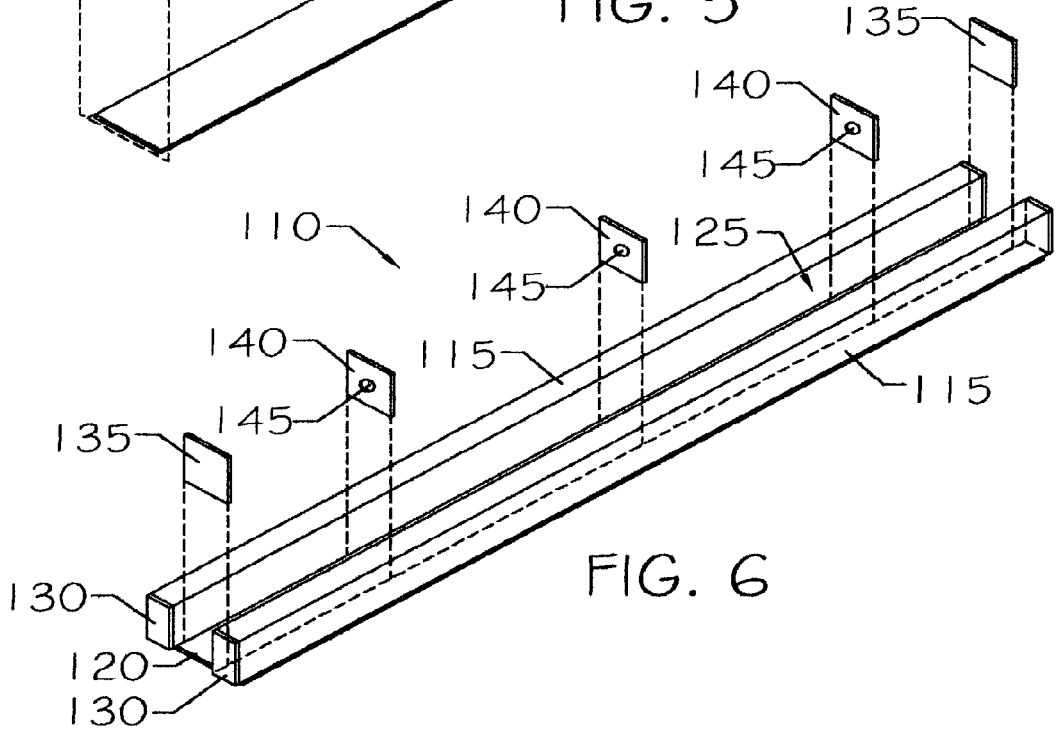
FIG. 6 shows a perspective view of another step in the fabrication of the embodiment of FIG. 5 of the floatable caisson member of the present invention.
Figure 7:
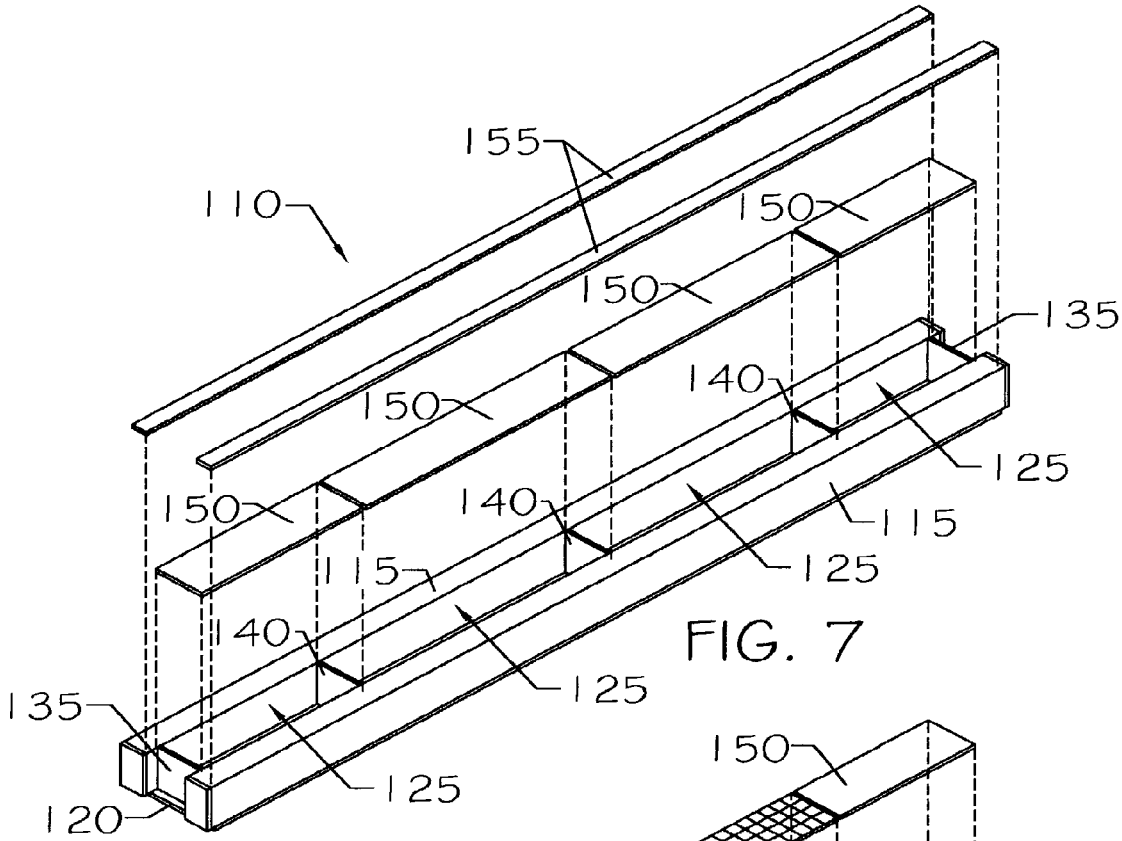
FIG. 7 shows a perspective view of a further step in the fabrication of the embodiment of FIG. 5 of the floatable caisson member of the present invention.

Referring now to FIGS. 5-7, the fabrication of another embodiment of the floatable caisson member 110 includes the steps of providing at least two hollow, rectangular section, steel tubes 115. These tubes are known as Hollow Structural Section (HSS) tubes that are fabricated by the processes described in detail above. Again, this embodiment is illustrated with two HSS steel tubes 115, but three or more HSS steel tubes 115 can be included with equivalent results. The HSS steel tubes 115 are preferably fabricated with a step of bending flat steel sheet that has a thickness sufficient to provide the structural characteristics required for use in a floatable caisson member 110. The HSS steel tubes 115 have a length sufficient to span a water opening of a dam, so that a bulkhead assembly made from a plurality of floatable caisson members 110 can isolate the water opening from a body of water. The HSS steel tubes 115 are preferably of equal length and of similar rectangular section.

A side plate 120 is secured to the at least two HSS steel tubes 115, with the at least two HSS steel tubes 115 and the side plate 120 defining at least one intermediate space 125, which has a rectangular cross section. The side plate 120 extends essentially the full width of the parallel HSS steel tubes 115 positioned thereon. This allows both adjacent and opposite edges of each HSS steel tube positioned on the side plate 120 to be secured, preferably by welding, thereto, as shown in FIGS. 5 and 6. In this embodiment, the side plate 120 also functions as tube cover plates, providing additional structural integrity for the caisson member 110. The HSS steel tubes 115 are sealed with end plates 130 so that the sealed HSS tubes 115 become chambers to selectively hold and release air. At least one pair of intermediate space end plates 135 is secured between adjacent HSS tubes 115. The intermediate space end plates 135 may be positioned anywhere within the intermediate space or at the end positions of the intermediate space, however, end plates 135 are preferably installed short of the ends of each HSS tube 115, as illustrated in FIGS. 6 and 7, such that the end plates 135 also function as diaphragms between the HSS tubes 115 and impart improved structural integrity to the floatable caisson member 110. Installing end plates 135 in such a recessed manner also eases the structural fastening of end plates 135 and fabrication of caisson member 110.

In a further embodiment of the invention, at least one diaphragm 140 is installed within the intermediate space 125 to subdivide the space 125, as illustrated in FIG. 6, where three such diaphragms 140 are installed. Installing at least one intermediate chamber plate 150 to the tubes 115 opposite the side plate 120 seals the intermediate space 125 to provide at least one additional sealed chamber. Preferably, the intermediate chamber plate 150 is secured to the adjacent tube edges of the intermediate space 125 opposite the side plate 120. As illustrated in FIG. 7, where the intermediate spaces 125 includes three diaphragms 140, the resulting four intermediate spaces 125 are sealed with four intermediate chamber plates 150. Each of the four intermediate spaces 125 may therefore be configured as sealable, intermediate chambers or sealed intermediate subchamber portions. One or more diaphragms 140 may include an opening 145 that provides fluid communication between adjacent, sealed, intermediate chambers. The aperture 145 may be a central aperture or selectively designed with slots or openings. The chamber plates 150 are secured, preferably by welding, to the end plate 135 and the diaphragm 140, as well as to the adjacent tube edges to seal the intermediate space 125. In addition, tube cover plates 155 may be secured to the tube 115 sides adjacent the intermediate chamber plates 150 for additional structural integrity, as illustrated in FIG. 7. Thus, each tube cover plate 155 is secured to a surface of one HSS steel tube 115, opposite the side plate 120.

Figure 8:
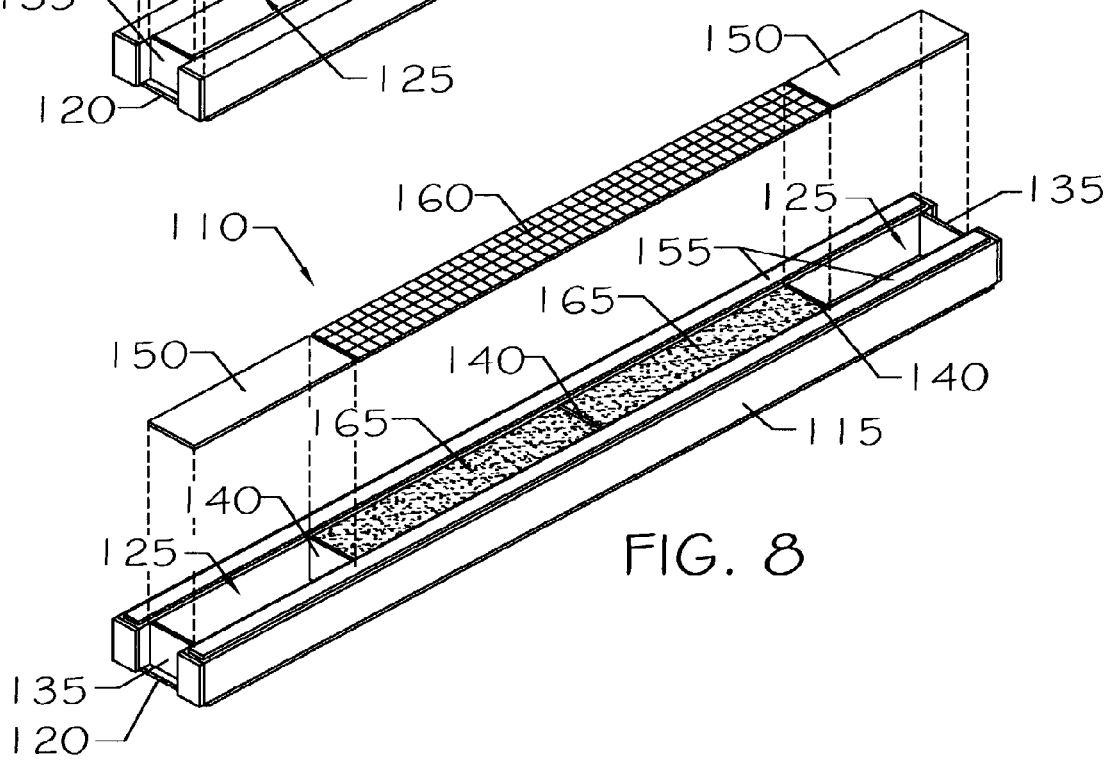
FIG. 8 shows a perspective view of an alternative step in the fabrication of the embodiment of FIG. 5 of the floatable caisson member of the present invention.

An alternative embodiment of the invention disclosed in FIGS. 5-7 is shown in FIG. 8. Referring to FIG. 8, the caisson member's intermediate space 125 is divided into four subchambers by three diaphragms 140, as described above. The two end subchambers are sealed by securing, preferably by welding an intermediate chamber plate 150 to the tube edges, the intermediate space end plate 135, and one diaphragm 140. The interior intermediate subchambers are covered only by intermediate chamber cover screens 160, leaving a void that fills with water upon submersion of the floatable caisson member. In a further embodiment, shown in FIG. 8, the interior, intermediate subchamber voids beneath the cover screens 160 are filled with buoyant foam material 165 to exclude water from the voids, thereby adjusting the buoyancy of the floatable caisson member 110.

Further aspects of the previous embodiments are described later with respect to a completed caisson such as that shown in FIG. 9B.

The use of hollow rectangular section (HSS) tubes made from flat sheet material accommodates easier and less expensive caisson fabrication, simplified caisson installation and a variety of engineering options. The HSS tubes 115 can be custom fabricated and sized to fit a particular application, whereas the wide flange beams are available only in set sizes. The wide flange member's flange edges must be butted together to form sealed chambers requiring expensive edge preparation, a difficult partial penetration butt weld that leaves an interior seam that weakens the joint and leaves a location to initiate corrosion The caisson fabrication method does not require personnel access for fabrication as do structure shown in some references. A further advantage of applicant's invention is the use of HSS tubes 115, configured with a cover plate 155 to provide additional structural integrity for the caisson member 110.

Figure 9A:
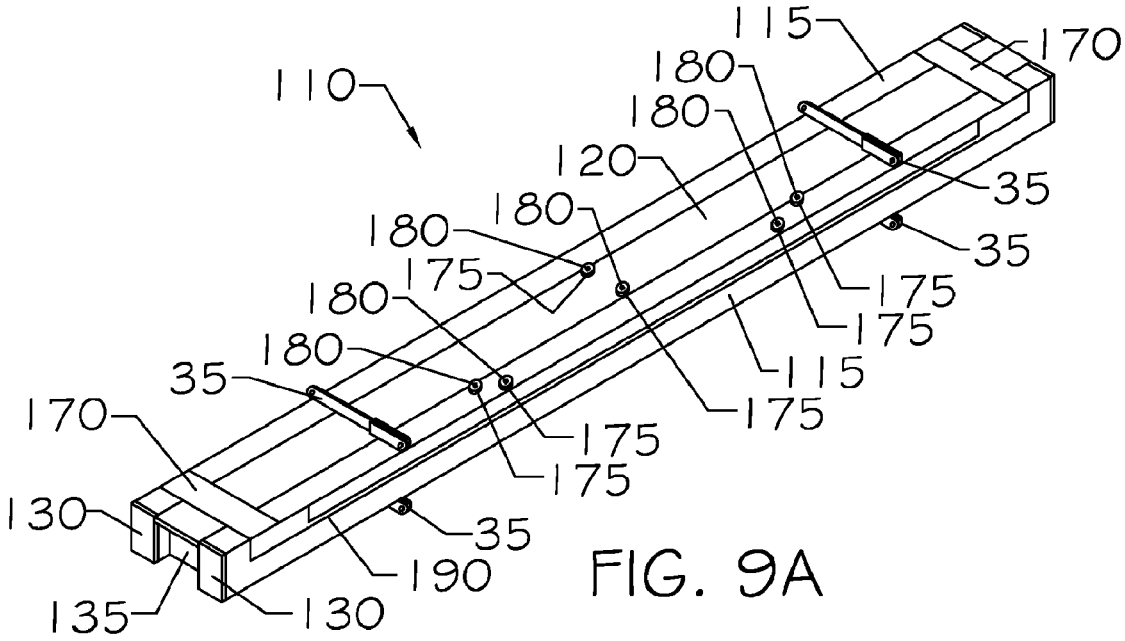
FIG. 9A shows a perspective view of another step in the fabrication of the embodiment of FIG. 1 of the floatable caisson member of the present invention.
Figure 9B:
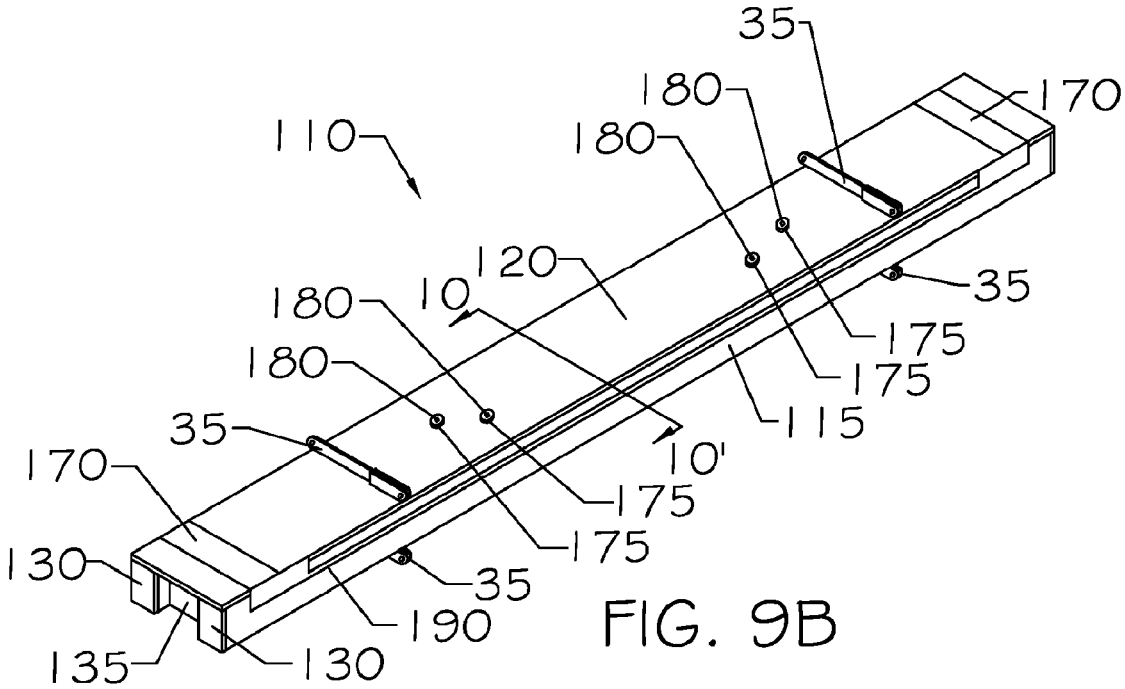
FIG. 9B shows a perspective view of another step in the fabrication of the embodiment of FIG. 5 of the floatable caisson member of the present invention.

Referring now to FIGS. 9A and 9B, fully assembled floatable caisson members 110 are shown. The structure shown in FIG. 9A corresponding to the structure shown in the embodiments described earlier concerning FIGS. 1-3. The structure shown in FIG. 9B corresponds to the structures shown in the embodiments described earlier concerning FIGS. 5-7. The sealed, intermediate space 125 and/or an HSS steel tube 115, includes a means for controlling air and water entry and exit from at least one sealed chamber of the floatable caisson member 110. For example, the sealed, intermediate space 125 is provided with at least one sealable aperture 175 for controlling air and water entry and exit therefrom. At least one aperture 175 is provided to selectively flood the sealed chamber (either the intermediate space 125 or portion thereof, or a steel tube 115), and to evacuate water from the sealed chamber. The sealable apertures 175 preferably include corresponding plugs 180 that are preferably manually inserted or removed to control air and water entry and exit.

In addition to use of plugs 180, aperture 175 may also include a valve as means for controlling air and water entry. It is also appreciated that a hose or tube from a water pump (not shown) or air compressor (not shown), for instance, may be associated with the aperture 175, such that the water pump or air compressor operate as means for controlling air and water entry.

The floatable caisson member 110 includes a plurality of fastening devices 35 installed on at least one exterior surface of the caisson member 110. Preferably, a pair of spaced apart fastener devices 35 is installed on each of two opposed exterior surfaces of the caisson member 110, as illustrated in FIGS. 9A and 9B. The fastening devices are preferably planar members that extend perpendicularly across the width of the caisson member 110. The fastening devices 35 have fastener openings 40 at each end thereof, with a slot at one fastener end to accept the planar fastener member 35 from another caisson member 110. Pins, bolts or turnbuckles (not shown) inserted through the mated fastener openings 40, secure adjacent caisson members 110 together. At least one rotatable fastening device 310 (see FIG. 12), for instance, may be secured to the exterior surface of the caisson member 110 for assembling a bulkhead assembly made of rotatable caisson members.

Figure 10:
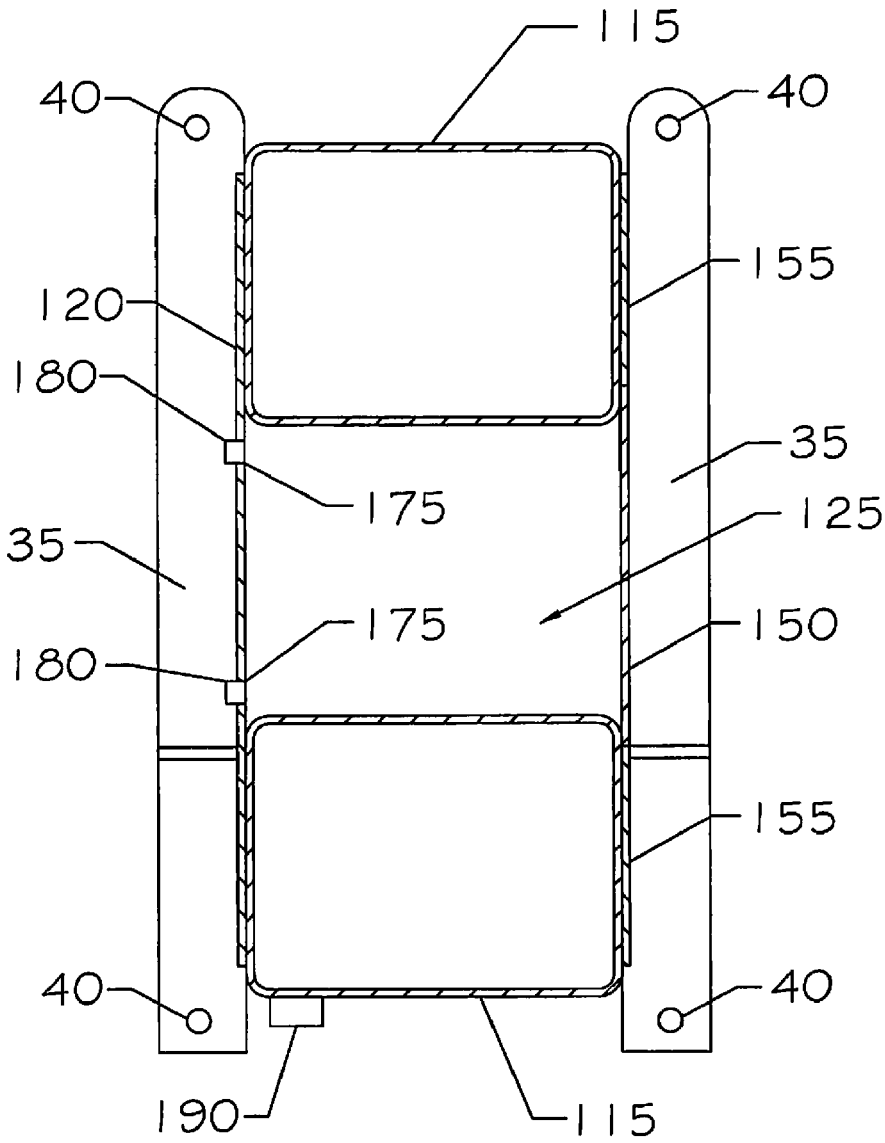
FIG. 10 shows a cross sectional view along line 10-10' of FIG. 9B.

A cross sectional view of the floatable caisson member 110 is shown in FIG. 10, where the caisson member side plate 120 extends to opposite edges of the HSS steel tubes 115 and both an intermediate chamber plate 150 and tube cover plates 155 are present. Additionally, a seal 190 extends substantially the length of one said at least two HSS steel tubes 115, the seal forming a watertight joint between adjacent, joined, floatable caisson members 110. An adjustable seal 170 (see FIGS. 9A, 9B and 11) also extends across the width of the caisson member 110 at both ends. This seal 170 abuts the face of the dam and/or a pier nose 340 (see FIG. 12) adjacent the water passage with the caisson member 110 in place. Seal 170 may be relocated on floatable caisson members 110 for different water passage opening spans. A bottom seal 192 (see FIG. 11) may be positioned on at least one caisson member 110 for forming a water tight joint between the caisson member 110 and sill 335, seat or structure face of the dam. Seals 170 and 192 accordingly engage the water passage structures such as the sill 335, pier nose 340, and dam face (not shown).

Figure 11:
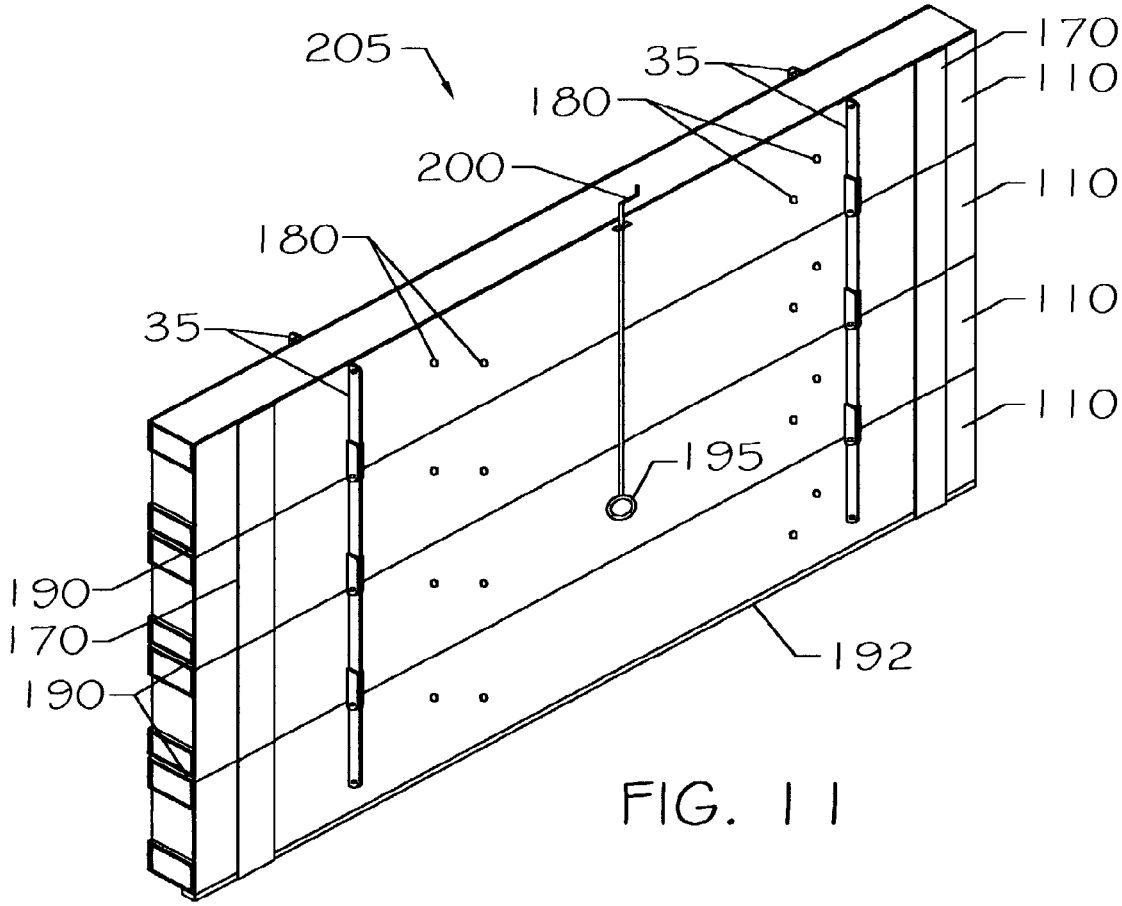
FIG. 11 shows a segmental floatable bulkhead assembly made from a plurality of floatable caisson members of the present invention and configured in a vertical attitude.

Referring now to FIG. 11, a unique segmental floating bulkhead assembly 205 is shown. The bulkhead assembly 205 consists of a plurality of individual, floatable caisson members 110, described in detail above, connected together on the upstream side and, optionally as shown, also on the downstream side. Preferably, each floatable caisson member 110 consists of three or more sealed horizontal chambers with a selected chamber used to vary the buoyancy of the bulkhead assembly 205. The floatable caisson members 110 are constructed of steel tube sections and plate, as described above, to form the various chambers, thereby simplifying fabrication, mitigating internal corrosion, and reducing manufacturing costs. Sealable apertures 175 are covered with corresponding plugs 180 that are manually inserted and removed to control air and water entry and exit to cause the bulkhead selectively to move between a horizontal attitude (not shown) and a vertical attitude (see FIG. 11). Additionally, water and air conduit means such as water hoses and air hoses may be assembled (not shown) to connect with aperture 175 for obtaining fluid communication with a selected one or more of the caissons 110. Preferrably, apertures 175 are manually sealable, but it may be appreciated that apertures 175 may be sealed non-manually. A sealable conduit 195 (see FIG. 11) is provided in at least one of the floatable caisson members 110 for selectively permitting flow of water from the water body through the bulkhead assembly 205. An extended valve handle 200 activates opening and closing of conduit 195.

In a further embodiment of the present invention, a method for isolating a water passage of a dam from a body of water is disclosed. The method includes the steps of providing a plurality of floatable caisson members 110 bound together to form a rigid, panel bulkhead assembly 205, adapted to float in a horizontal attitude on a water body surface. At least one of the caisson members 110 include at least two HSS steel tubes 115 connected in parallel with a side plate 120, the HSS tubes 115 and the side plate 120 defining at least one intermediate space 125, with the at least two tubes 115 sealed with tube end plates 130 to form at least two sealed chambers, and at least a portion of the at least one intermediate space 125 sealed to create at least another sealed chamber, with at least one of the sealed chambers including at least one aperture 175 to selectively flood the sealed chamber and evacuate water from the sealed chamber. The floatable caisson members 110 are connected together to form a bulkhead assembly 205, adapted to float in a horizontal attitude on the surface 325 of the body of water. At least one of the sealed chambers within at least one of the floatable caisson members 110 is flooded to cause the bulkhead assembly 205 to move from the horizontal attitude to a vertical attitude in the body of water. The bulkhead assembly 205 is moved in the vertical attitude to a position contacting water passage piers. The bulkhead assembly 205 is held against the piers, and selectively flooding of at least a further of said at least one sealed chambers occurs to reduce buoyancy of the bulkhead assembly 205 to cause the bulkhead assembly 205 to sink to the sill of the water passage. Water from the space between the water passage's gate and the bulkhead assembly 205 is then evacuated.

Additional details of the above method include the following. Each floatable caisson member 110 is placed on the reservoir and pinned together on the upstream side, as well as fastened together by turnbuckles (not shown) on the downstream side, to form a rigid, unitary bulkhead assembly 205. Sealable apertures 175 positioned on the downstream face of selected, floatable caisson members 110 are opened to allow reservoir water to flood the caisson member's selected chamber. Opening an aperture 175 at each end of the bottom caisson member 110, for instance, floods the selected chamber to initiate descent of the bulkhead assembly 205 as a unitary structure. As the bulkhead assembly moves from a horizontal to a vertical position, the various open apertures 175 in the other, floatable caisson members 110 fill with water to provide ballast, much like the keel of a ship. No air compressors or water pumps are needed for installation, in contrast to prior floating bulkhead assemblies. Further, the buoyant force is distributed among the various floatable caisson members 110 so that high strength rods are not needed to tie the caisson members 110 together. Additionally, the bulkhead assembly 205 of the present invention does not require hoists or rigging to control the descent of the caisson members 110, as with certain other segmented bulkhead assemblies (Ayres Design).

Once in the vertical position, the bulkhead assembly 205 is moved to the dam water passage to be dewatered. The bulkhead assembly 205 is lowered to the dam sill, seat or structure face by opening apertures 175 in another caisson member's selected chamber until the bulkhead assembly 205 is positioned properly. The water passage of the dam is drained to seat the submerged bulkhead assembly 205 against the water passage structures, such as the sill 335, pier nose 340 or dam face. Water drains from the ballasted, selected chambers via apertures 175 on the caisson member's downstream side, as the water passage is emptied. The downstream chamber apertures 175 are closed after draining, except for those needed for ballasting during removal of the bulkhead assembly 205. In the vertical, floating position, before it is seated, the bulkhead assembly 205 can be moved from one water passage to another without bringing the bulkhead assembly 205 to a horizontal attitude, provided the reservoir pool is sufficiently deep.

Gate 315 (see FIG. 12) may be returned to operation when bulkhead assembly 205 is moved from the water passage. Water is evacuated from at least one of the sealed chambers and at least one aperture 175 is sealed to prevent flooding of the chamber. The space A between the water passage gate and the bulkhead assembly 205 is flooded to allow the bulkhead assembly to float off the water passage sill 335, preferably by opening sealable conduit 195. The bulkhead assembly 205 may also be moved from the pier nose 340, dam face or water passage. Additional selected sealed chambers may also be evacuated and sealed to allow the bulkhead assembly 205 to move from the vertical attitude to the horizontal floating attitude. The caisson members 110 may be disconnected from each other and removed from the body of water for dry storage.

Figure 12:
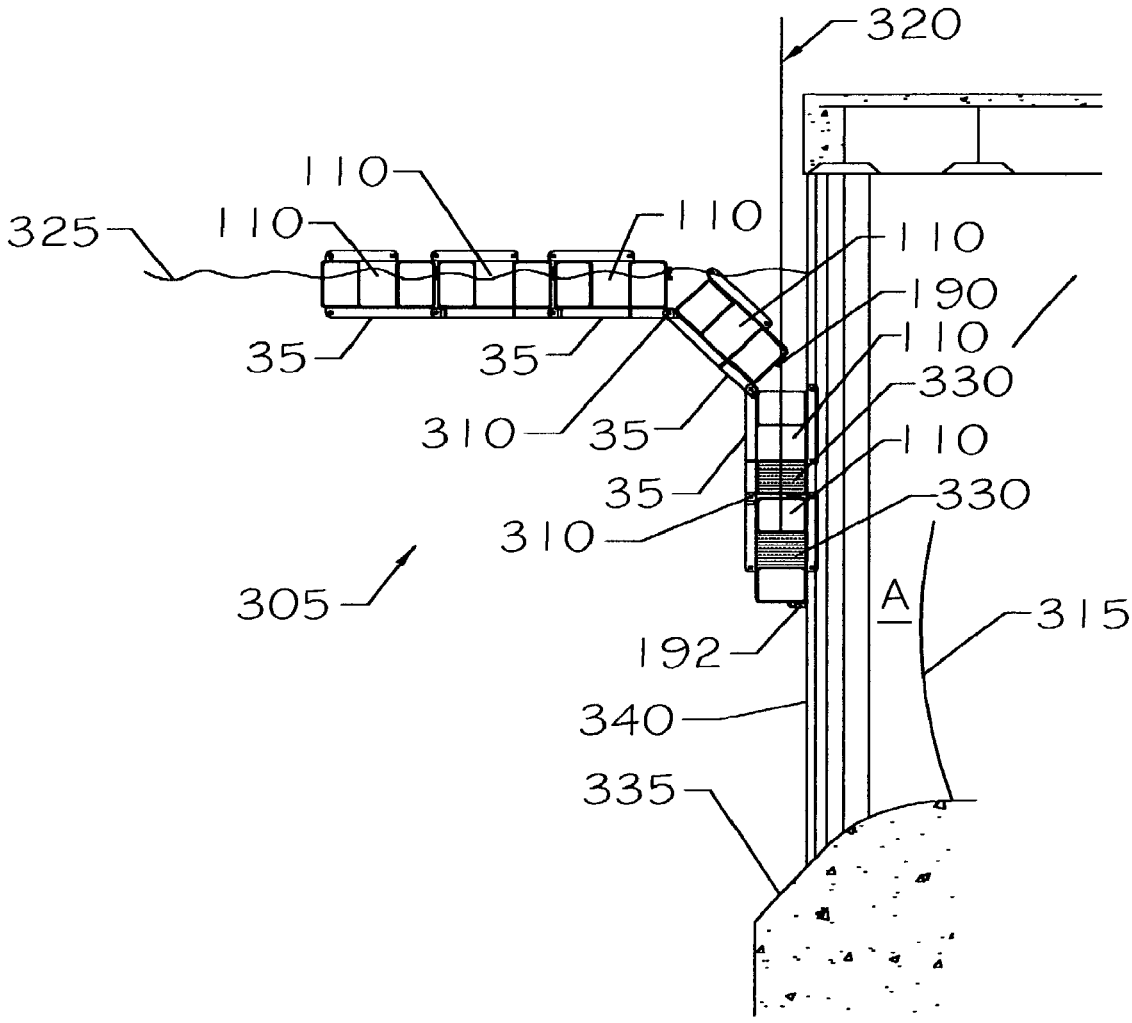
FIG. 12 shows a segmental floatable bulkhead assembly of the present invention during installation, using the rotatably connected method.
Figure 13A:
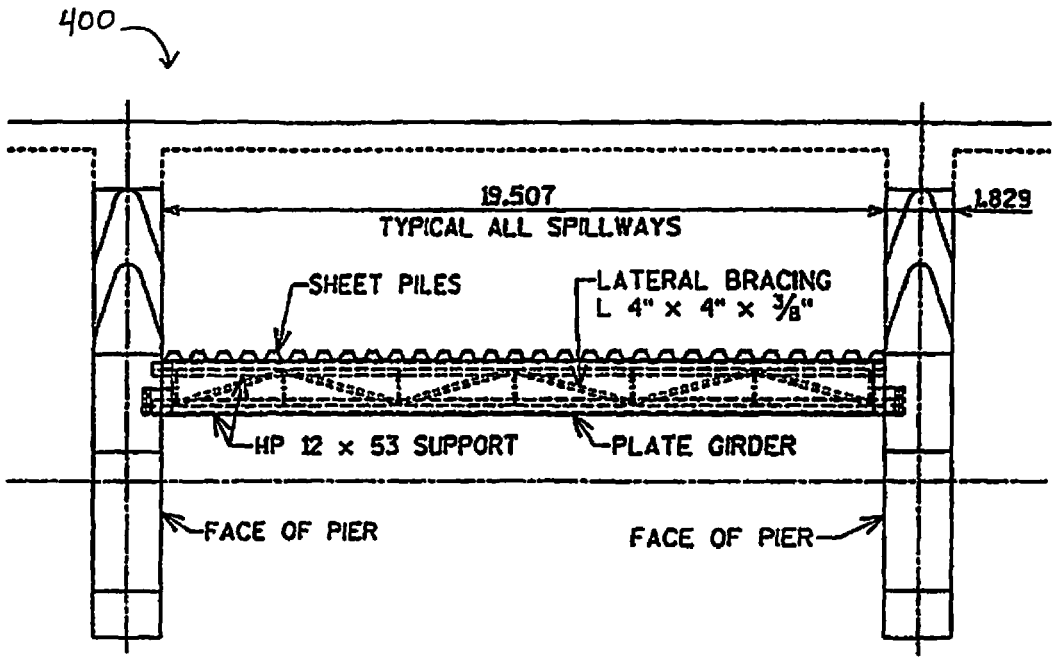
Fig. 13A (Prior Art)
FIG. 13A shows a plan view of a prior art needle-beam coffercam.
Figure 13B:
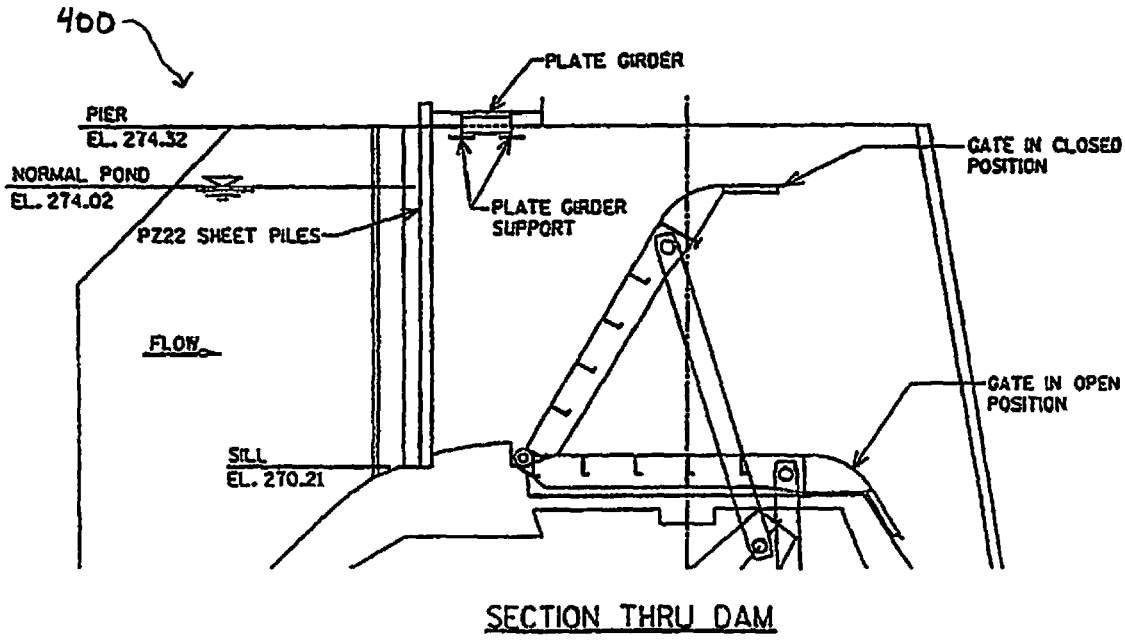
Fig. 13B (Prior Art)
FIG. 13B shows a section view of the prior art needle-beam cofferdam of FIG. 13A.

In a further embodiment of the present invention, another method for isolating a water passage of a dam from a body of water is disclosed. Referring to FIG. 12, the segmental floating bulkhead assembly 305 is shown during installation at a water passage. The method includes the steps of providing a plurality of floatable caisson members 110 adapted for rotatably binding together to form a segmental bulkhead assembly that floats in a horizontal attitude on a water body surface. At least one of the caisson members 110 includes at least two HSS steel tubes 115, connected in parallel with a side plate 120, with the HSS tubes 115 and the side plate 120 defining at least one intermediate space 125. The at least two tubes 115 are sealed with tube end plates 130 to form at least two sealed chambers, with at least a portion of the at least one intermediate space 125 sealed to create at least another sealed chamber. At least one of the sealed chambers includes at least one sealable aperture 175 to selectively flood the sealed chamber and evacuate water from the sealed chamber. Allowing for the selection of any one of the sealed chambers to be configured to selectively hold and release air provides for a variety of design and engineering options. For instance, selecting the intermediate chamber allows engineers to alter the dimensions of the caisson member and other caissons.

At least two of the floatable caisson members 110 are rotatably connected together to form a rotatable, segmental bulkhead assembly 305 adapted to float in a horizontal attitude on the surface 325 of the body of water. The bulkhead assembly 305 is moved in the horizontal attitude to a position adjacent the water passage piers 340 or water passage structure, with one caisson member 110 floating adjacent the water passage and one caisson member 110 floating opposite the water passage structure. Piers 340 and sill 335 define the water passage. A hoist 320 is connected to each end of the caisson member 110 floating adjacent to the water passage structure. At least one sealed chamber of the bulkhead assembly caisson member 110, which is adjacent the water passage, is flooded and the caisson member 110 is lowered with the hoist 320 to cause the caisson member 110 to move from the horizontal attitude to a submerged, vertical attitude in the body of water. The flooding step is repeated for selected sealed chambers of selected floating caisson members 110 adjacent the water passage and the caisson member 110 is lowered with hoist 320 to move the selected caisson members 110 to a submerged vertical attitude, causing the segmental bulkhead assembly 305 to sink to the sill of the water passage, seat or structure face. Water from a space A between the water passage gate 315 and the segmental bulkhead assembly 305 is then evacuated. As shown in FIG. 12, caisson 110 is longitudinally pivotally connected to an adjacent caisson 110 (i.e., caisson 110 pivots longitudinally with respect to an adjacent caisson 110). Pivoting occurs along a length of the respective caissons, similar to how panels of a garage door pivot.

When the segmental, floating bulkhead assembly 305 requires removal, the hoist line 320 is removed from the bulkhead assembly 305. Water is evacuated from at least one of the sealed chambers sufficient to allow the bulkhead assembly 305 to float off the sill 325 of the water passage. At least one of the caisson member chamber valves or apertures 175 are then sealed or closed to prevent flooding of the at least one sealed chamber. The water passage gate 315 is closed and at least one sealable bypass conduit 195 located in at least one caisson member 110 is opened to allow reservoir water to fill the water passage. Bypass conduit 195 may be manually sealed or un-sealed with handle 200 to effective desired flooding of space A. It may be appreciated that a variety of valves may be used for sealing and un-sealing conduit 195. The segmental floating bulkhead assembly 305 rises slowly along the piers once water pressure is equalized between the reservoir and the previously emptied water passage area A. Water is evacuated from one or more caisson members 110 and one or more caisson members is re-sealed until each of the caisson members are moved from the vertical attitude to the horizontal floating attitude. Since the floatable caisson members 110 can rotate about the hinge pins on the upstream side, as each floatable caisson member 110 approaches the surface, buoyant forces causes the caisson members 110 to pivot about the connecting pins 310, positioning the downstream side of each caisson member 110 upward. No hoists, cranes or other heavy rigging are required to float the bulkhead assembly 305. The bulkhead assembly 305, which is now in a horizontal orientation, can be converted to a unitary structure by reconnecting the fasteners 35 between adjacent caisson members 110. This task is readily accomplished, since the unfastened bulkhead assembly side is atop the floating bulkhead assembly 305. The bulkhead assembly 305 is then moved to another water passage intake for installation, as described above. Should the segmental floating bulkhead assembly 305 require transport to a distant location or storage, the floatable caisson members 110 are disconnected, and each caisson member 110 is extracted from the reservoir.

This segmental, floatable bulkhead assembly 305 provides easy maneuverability and maximum flexibility, compared to other similar bulkhead assemblies. Only a few hours are required to install or remove the segmental, floatable bulkhead assembly 305. Also, the need for divers to assist with installation and removal is minimized, thus providing additional cost savings.

Thus, the individual caisson members 110 that are assembled to form a segmental bulkhead assembly 305 meet the five general criteria for caisson members enumerated above. The present invention provides an improvement over existing caisson member structures, an improvement in the method of their fabrication and improvement in the methods of isolating a dam water passage from a body of water.

Figure 15:
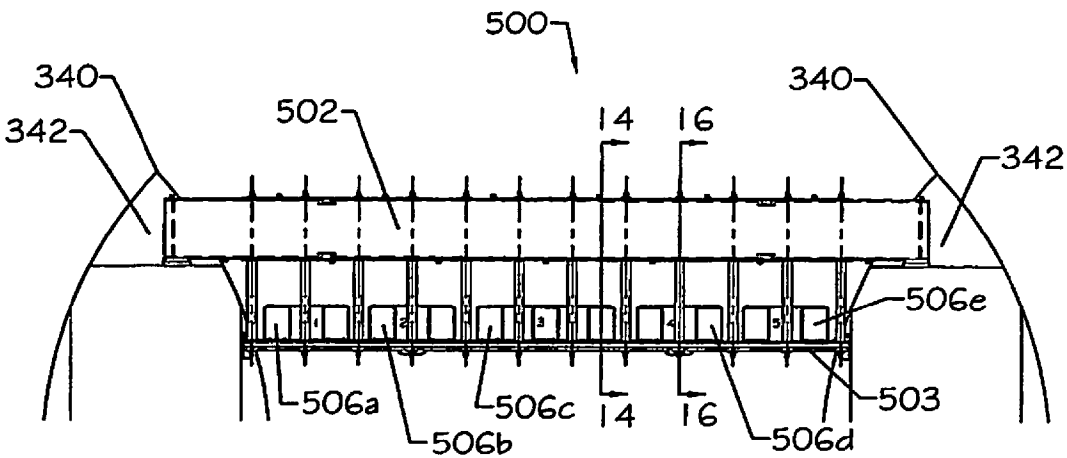
FIG. 15 shows a plan view of a needle-beam cofferdam made in accordance with a further aspect of the present invention.

Referring to the Figures, including FIGS. 14-19, a further aspect of the invention is shown. A needle beam cofferdam 500 is generally shown in FIG. 15. Dam 500 includes a support beam 502 positioned at nose pier 340. Support beam 502 abuts piers 340 and may hang from a hanger, or may be positioned at piers 340 in other manner. Support beam 502 may be positioned on beam sill 342 as shown or in other configuration. Support beam 502 is typically made of steel and fitted into position, however it may be appreciated that a support beam 502 may also be made of other materials and may include a current header or other structure of a dam that is already in place. Dams that have a sufficient header might therefore require little or no preparation work to include a support beam 502 if one already exists as part of the structure. Accordingly, a support beam 502 of the present invention is intended to include header structures that may already be present as well as header structures fitted into position for use in the present invention.

Figure 19:
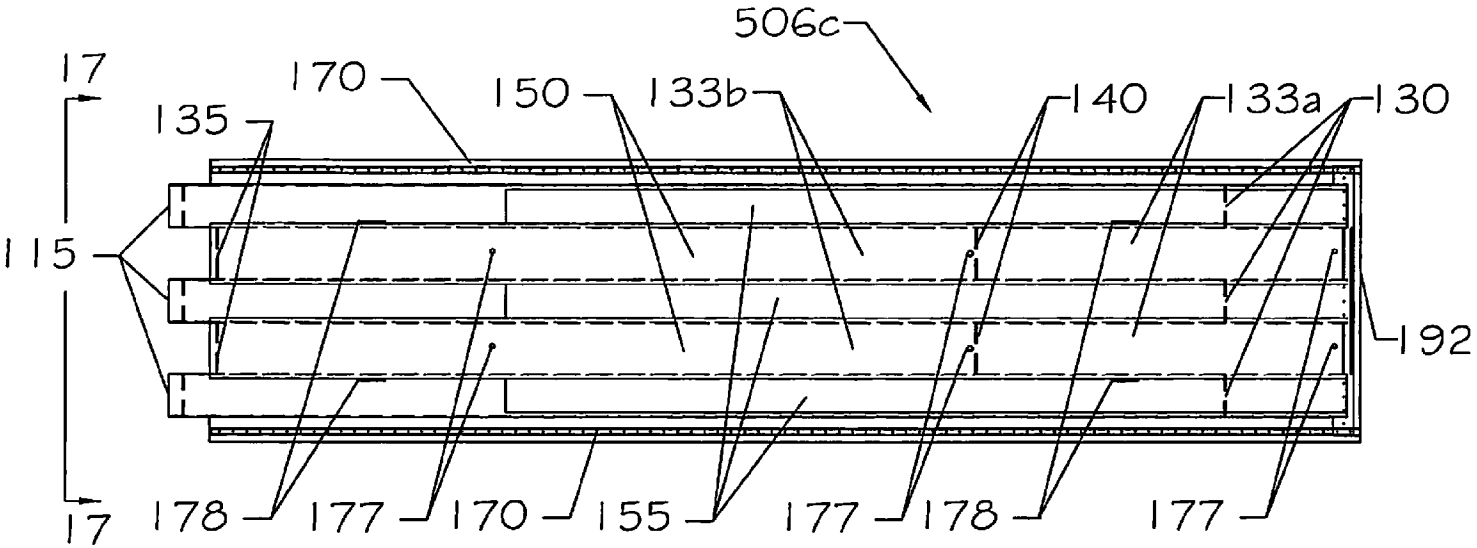
FIG. 19 is a plan view of the needle beam of FIG. 17.
Figure 18:
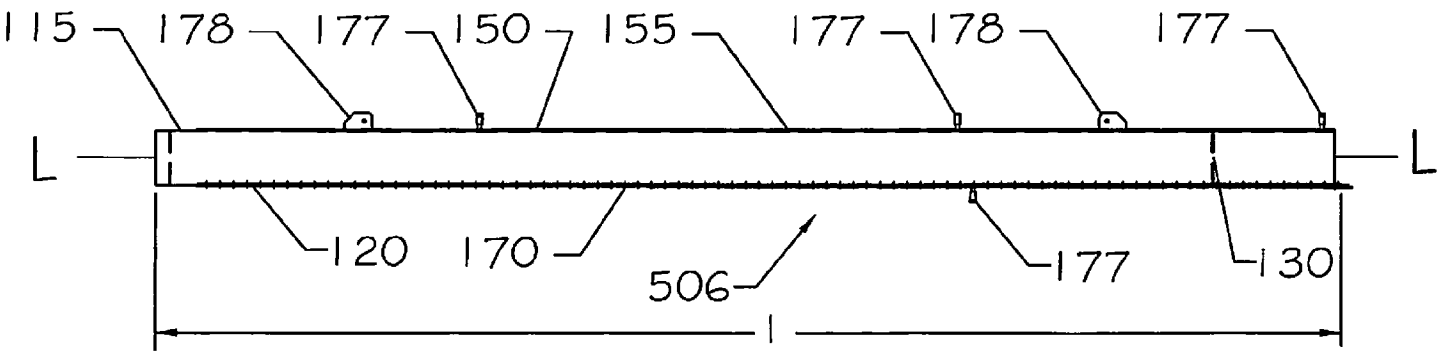
FIG. 18 is an elevation view of the needle beam of FIG. 17.

A plurality of needles 506 are positioned to span between a pair of piers 340 or other water passageway of a dam. As shown in FIG. 15, needle beam coffer dam 500 includes multiple needles 506*a*, 506*b*, 506*c*, 506*d* and 506*e*. Needles 506 may vary from one to the other. Needle beam 506 is made of metal, preferably steel, and is a hollow structural element. Needle 506 may include a caisson, including caisson 110 as described above and incorporated herein by reference. Needle 506 is capable of being sealed and may include a structure made from steel plate material, wide flange beam material, a tube material, including HSS steel tube, and other metal structure materials capable of being sealed. Needle 506 is an elongated element having a length "l" which is substantially greater than a width "w". Needle 506 includes a major axis "L". Preferably needle 506 includes an elongated hollow tube, such as an HSS tube. More preferably needle includes an HSS steel tube having a rectangular cross section. One non-limiting example as shown in FIGS. 18 and 19 depicts needle 506 having length "l" of greater than 500 inches. Needle 506 is a structurally supporting element and thus may be of a length that is greater than prior needle systems. For instance, needle 506 may extend to, and beyond 30 feet in length. While prior systems may use needles of the wooden variety of roughly 10 feet or so in length, and others such as sheet piles of roughly 27 to 30 feet in length, the present needles 506 extend beyond those prior structural limits, such as beyond 30 feet. The present example uses a needle 506 extending approximately 43 feet. Lengths beyond 43 feet are capable with needles 506. Needle 506 may include a single hollow structural element such as an HSS tube 115, or may be combined with other structures, including additional hollow elements (including additional tubes 115), to create a needle 506. Needle 506*a* shows use of a double tube 115 structure, for instance, and needle 506*c* shows use of a triple tube 115 structure, for instance. Additional tubes 115 may also be used for needle 506.

Additional aspects of needle 506 are shown with reference to caisson 110 as shown in FIGS. 1-10. In one aspect as shown in FIG. 3, needle 506 includes caisson 110 having at least two HSS steel tubes 115 having a rectangular cross section. Tube 115 includes a major axis "L" which has a dimension substantially greater than a width of tube 115. A side plate 120 is welded to the two tubes 115, and together plate 120 and tubes 115 define intermediate space 125. Intermediate space 125 may be sealed to form a sealed chamber as described above. Tubes 115 may also be sealed to form a sealed chamber. At least one sealable aperture 175 is provided in communication with the sealed chamber. Preferably caisson 110 includes at least one subchamber 133.

In operation, needle 506 may be positioned by transporting caisson 110 atop the water upstream of the dam. Caisson 110 floats to a position adjacent pier 340. At least a portion of needle 506 is then flooded which causes needle 506 to be generally vertically positioned in the water. The amount of needle 506 which extends above or below the surface may be adjusted by controlling the air/water volume within the hollow needle. In one instance, subchamber 133*a* may be flooded to effectuate rotation of needle 506 from a horizontal position to a generally vertical position. Needle 506 is then positioned to engage with sill 335 at one end of needle 506 where the other end of needle 506 is engaged with support beam 502. Needle 506 is positioned with major axis L substantially vertically oriented. Seals may be positioned between needle 506 and sill 335. Additional needles 506 may also be positioned in a similar fashion. Appropriate seals, including side seals (positioned between a needle 506 and the pier 340), bottom seals (between the needle 506 and sill 335) and intermediate seals (between respective needles 506) may be positioned to minimize leaking. Neoprene bearing pads and flat seals may be inserted or bolted into appropriate position. Respective needles 506 may be positioned in a side-by-side vertical arrangement to span between piers 340, 340 of the water passage.

Figure 17:
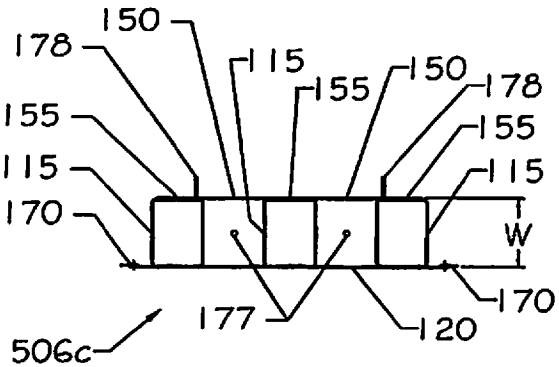
FIG. 17 is a side view of a needle beam made in accordance with a further aspect of the present invention.
Figure 16:
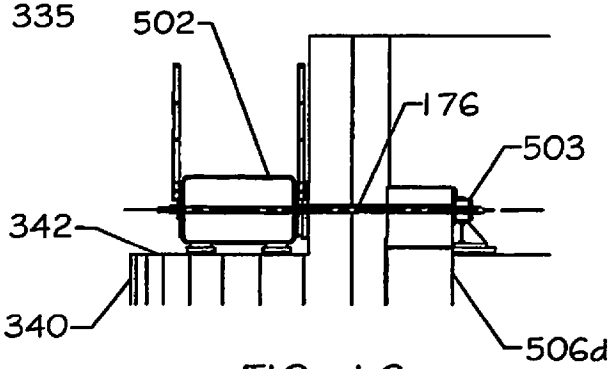
FIG. 16 shows a cross section view taken along line 16-16 of FIG. 15.

A further aspect of the invention is shown with reference to FIGS. 14-19 where dam 500 includes at least one needle 506 and preferable a plurality of needles 506. FIG. 17 and FIG. 19 show needle 506*c* having three HSS steel tubes 115. It may be appreciated that needle 506 may include a single sealable element, two sealable elements or three or more sealable elements. FIG. 15 shows needles 506*a*, 506*b* 506*d*, and 506*e* each having two sealable elements such as HSS steel tubes 115, with needle 506*c* having three HSS steel tubes 115. Intermediate chamber plates 150 are positioned between tubes 115 and in part define intermediate space 125 which may be sealed. Tubes 115 may also be sealed. Side plate 120 is positioned opposite chamber plates 150. Diaphragm 140 is positioned within space 125 which in part defines subchamber 133*a*, 133*b*. Apertures 175 and valves 177 are provided to effectuate flooding and/or evacuation of chambers 150. Lifting lugs 178 are provided so needle 506 may be lifted. At least one needle may include a bypass valve 179 to allow water to pass through dam 500 to fill the space between dam 500 and a dam gate, for instance, in order to remove needles 506. Cover plates 155 may be positioned upon tubes 115 for additional structural support.

Figure 14:
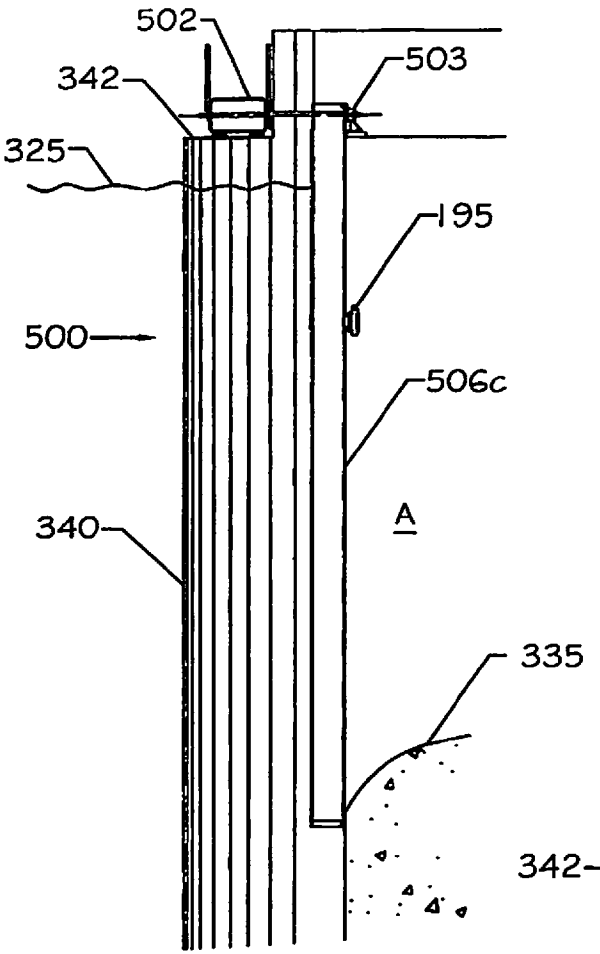
FIG. 14 shows a cross section view taken along line 14-14 of FIG. 15.

Needle beam coffer dam 500 may be configured with needles 506 abutting support beam 502, or may have needles in a "reverse" position as generally shown in FIG. 14. Needles 506 in a reverse position are downstream from support beam 502. A downstream beam 503 is provided so that needles 506 may operatively engage with support beam 502. A threaded rod 176 or other element may run through downstream beam 503 and needle 506 and connect through support beam 502.

While the present invention has been described with reference to several particular example embodiments, those skilled in the art will recognize that many changes may be made thereto without departing from the spirit and scope of the present invention, which is set forth in the following claims.

What is claimed is:

1. A method for dry isolation of a water passage of a dam, the method comprising:

positioning adjacent the water passage of the dam at least a first floatable needle, said at least first needle comprising:

at least two HSS steel tubes, at least one of said HSS steel tubes having a rectangular cross section and defining a major axis;

a side plate welded to said at least two HSS steel tubes, said at least two steel HSS tubes and said side plate defining at least one intermediate space between said at least two HSS steel tubes; and at least one of said intermediate space and said at least two HSS steel tubes sealed to form a sealed chamber;

said positioning of said first needle includes positioning said first needle such that said major axis is substantially vertically oriented; and positioning a second needle adjacent said first needle.

2. The method of claim 1 wherein said first needle includes at least one sealable aperture in communication with said sealed chamber.

3. The method of claim 2 wherein said sealable aperture having a valve.

4. The method of claim 2 wherein said sealable aperture having a removable seal.

5. The method of claim 1 wherein said positioning said first needle adjacent the water passage includes positioning said first needle such that said major axis is substantially horizontally oriented and wherein said first needle is longitudinally pivotally connected to said second needle.

6. The method of claim 1 wherein said first floatable needle is a caisson, and wherein said method further comprises providing a plurality of floatable caissons and horizontally positioning said caissons to span between the water passage.

7. A method for dry isolation of a water passage of a dam, the method comprising:

providing at least one floatable needle comprising:

at least two HSS steel tubes, at least one of said HSS steel tubes having a rectangular cross section and defining a major axis;

a side plate welded to said at least two HSS steel tubes, said at least two steel HSS tubes and said side plate defining at least one intermediate space between said at least two HSS steel tubes; and at least one of said intermediate space and said at least two HSS steel tubes sealed to form a sealed chamber; and positioning said needle adjacent the water passage of the dam such that said major axis is substantially vertically oriented.

8. The method of claim 7 further comprising at least one sealable aperture in communication with said sealed chamber and wherein said sealable aperture includes a valve.

9. The method of claim 7 further comprising providing a head support and positioning said needle against said head support.

10. A method for dry isolation of a water passage of a dam, the method comprising:

floating adjacent the dam at least one hollow metal needle having a major axis, said needle comprising at least two tubes and having at least one intermediate space between said at least two tubes; and flooding at least a portion of said needle to orient said needle from a generally horizontal position to a position where the major axis of said needle is substantially vertically oriented, the hollow needle engaging with a sill of the dam and engaging with a support beam which spans between piers of the water passage.

11. The method of claim 10 wherein at least one of said tubes is a HSS steel tube.

12. The method of claim 10 wherein at least one of said two tubes is a HSS steel tube, at least one of said tubes having a rectangular cross section and defining the major axis;

a side plate welded to said at least two tubes, said at least two tubes and said side plate defining said at least one intermediate space between said at least two tubes;

at least one of said intermediate space and said at least two tubes sealed to form a sealed chamber; and at least one sealable aperture in communication with said sealed chamber.

13. The method of claim 1 wherein the needle includes a sealed chamber and at least one sealable aperture in communication with the sealed chamber.

14. The method of claim 1 wherein the needle comprises at least one steel material selected from the group consisting of a steel plate, a wide flange beam, or an HSS tube.

15. The method of claim 1 further comprising a plurality of hollow needles, positioning the needles in a side-by side vertical arrangement to span between piers of the water passage.

16. The method of claim 1 wherein the needle abuts the sill and abuts the support beam.

17. The method of claim 1 wherein the needle is engaged with the support beam by positioning the needle downstream from the support beam.

18. The method of claim 1 wherein said needle has a length of greater than 30 feet.

* * * * *